US006347724B1

(12) United States Patent
Chen et al.

(10) Patent No.: US 6,347,724 B1
(45) Date of Patent: Feb. 19, 2002

(54) AUTOMATIC DISPENSER APPARATUS

(75) Inventors: Zefu Chen, Greenacres; James B. O'Maley, Lighthouse Pt.; Francis J. Parker, Cooper City, all of FL (US)

(73) Assignee: UltraClenz Engineering Group, Riviera Beach, FL (US)

( * ) Notice: Subject to any disclaimer, the term of this patent is extended or adjusted under 35 U.S.C. 154(b) by 0 days.

(21) Appl. No.: 09/704,034

(22) Filed: Nov. 1, 2000

(51) Int. Cl.[7] ..... B67B 7/00

(52) U.S. Cl. ..... 222/1; 222/95; 222/181.3; 222/214; 222/333; 222/63

(58) Field of Search ..... 222/52, 63, 95, 222/181.3, 207, 214, 333, 1

(56) References Cited

U.S. PATENT DOCUMENTS

| | | | | | |
|---|---|---|---|---|---|
| 3,659,512 | A | * | 5/1972 | Dietz et al. | 95/13 |
| 4,280,638 | A | | 7/1981 | Keihm | 222/180 |
| 4,615,476 | A | | 10/1986 | Hobbs et al. | 222/153 |
| 4,651,902 | A | | 3/1987 | Hobbs et al. | 222/153 |
| 4,673,109 | A | | 6/1987 | Cassia | 222/153 |
| 4,886,192 | A | | 12/1989 | Cassia | 222/181 |
| 5,186,360 | A | | 2/1993 | Mease et al. | 222/63 |
| 5,209,377 | A | | 5/1993 | Steiner et al. | 222/189 |
| 5,255,822 | A | * | 10/1993 | Mease et al. | 222/63 |
| 5,344,047 | A | | 9/1994 | Chen | 222/63 |
| 5,464,125 | A | | 11/1995 | Daansen | 222/156 |
| 5,492,247 | A | | 2/1996 | Shu et al. | 222/63 |
| 5,501,372 | A | | 3/1996 | Daansen | 222/207 |
| 5,507,413 | A | | 4/1996 | Chen | 222/63 |
| 5,598,952 | A | | 2/1997 | Daansen | 222/105 |
| 5,613,625 | A | | 3/1997 | Specht | 222/180 |
| 5,992,698 | A | | 11/1999 | Copeland et al. | 222/180 |
| 6,036,056 | A | * | 3/2000 | Lee et al. | 222/63 |

* cited by examiner

*Primary Examiner*—Kevin Shaver
*Assistant Examiner*—Melvin Cartagena
(74) *Attorney, Agent, or Firm*—Jay H. Maioli

(57) ABSTRACT

A dispenser apparatus and dispensing method for dispensing a product stored in a container by pressing a dispensing tube connected to the container. A motor rotates a cam that extends a press plate to press the dispensing tube against a back plate. A check valve permits unidirectional dispensing of the product from the container. A pinch-off unit pinches the dispensing tube or a second check valve is used to prevent the product from returning to the container while the press plate presses against the dispensing tube.

31 Claims, 2 Drawing Sheets

AUTOMATIC DISPENSER APPARATUS

BACKGROUND OF THE INVENTION

1. Field of the Invention

The present invention relates to a dispenser apparatus and a method for dispensing a product therefrom. More particularly, this invention relates to an apparatus wherein a dispensing tube is squeezed to dispense product from a container in the dispenser.

2. Description of the Related Art

Dispenser units are common in everyday life and dispense many different types of products. The dispensed products may range from liquid to solid substances, and the dispensers may be found in a variety of different environments. The products may include antimicrobial soap, antibacterial soap, lotion, and medicinal products. One typical use for a dispenser unit is to supply hand soap to a user of a restroom.

It is also well known that maintaining a high level of employee hygiene is critical in the food service industry and healthcare professions, where the spread of bacteria and viruses can ultimately endanger a person's health. Numerous inventions such as touch-free, automatic soap dispensers, faucets and hand dryers attempt to address the problem of workplace hygiene by making it easier for employees to wash their hands without touching surfaces that could contribute to contamination.

Some existing manual dispensers utilize a hand-operated lever to compress a tube and discharge a unit of soap or the like. Aside from the obvious hygiene concerns with such a dispenser, the compression of the tube results in some amount of product being forced back into a container where it was first stored, instead of into a user's hand. This results in the user operating the lever for more product, or designing the tube to be longer to hold more product, or performing other methods to deliver more product to the user per lever operation.

Many conventional "touch-free" dispensers work on the same general principles as the manual dispensers, that is, squeezing a tube to dispense product, but utilize an infrared unit that signals the dispenser automatically to discharge a unit of product when a user triggers an infrared sensor with his hand. While these dispensers may reduce the possibility of transmitting germs through direct user contact, they nevertheless still suffer from the same problem of forcing some of the product back into the container when the tube is compressed, ultimately resulting in product waste. In addition, some of the product dispensed is actually drawn back into the tube as the dispenser readies itself for the next discharge cycle. This increases the possibility of contaminating the product in the tube and, by extension, the container storing the product. Furthermore, such dispensers typically have tight operating tolerances and can only accommodate containers and tubes of a specific size rather than a range of sizes.

OBJECTS OF THE INVENTION

It is an object of the current invention to solve the problems discussed above relating to dispensers.

Specifically, it is an object of the current invention to provide a means for preventing the product from being pushed back into the container when the dispensing tube is squeezed during a discharge cycle.

In addition, it is an object of the current invention to provide a means for preventing the dispensed product from being drawn back into the dispensing tube once it has been discharged.

It is also an object of the current invention to allow for universal adaptability to different sizes and types of containers by providing removable and interchangeable components, such as dispensing tubes and back plates.

SUMMARY OF THE INVENTION

One embodiment of the present invention relates to a dispenser apparatus including: a housing; a container inserted into the housing for storing a product; a dispensing tube connected to the container to direct flow of the product from the container and having an open end; a motor mounted in the housing; a cam rotatably driven by the motor; a back plate attached to the housing; a crank with a proximate end mounted on the cam; and a press-plate connected to a distal end of the crank for pressing the dispensing tube against the back plate when the cam rotates a predetermined distance to discharge the product through the open end of the dispensing tube. The apparatus further comprises a sensing unit for triggering the dispenser apparatus to discharge a unit of the product when a user places an object within a predetermined proximity to the sensing unit, wherein a user-selectable number of units of the product are discharged when a user places an object within a predetermined proximity to the sensing unit. One unit of the product is discharged when the cam rotates one complete cycle. The container may be one of a disposable container and a refillable container. The apparatus can further include an exit port located on the container from which the product is discharged, wherein the dispensing tube is removably attached to the exit port of the container. The apparatus typically includes a check valve located in the open end of the dispensing tube to permit unidirectional dispensing of the product from the container. The motor has a rotatable output shaft with a gear mounted thereon that engages a final gear mounted on the cam through at least one gear. The apparatus also includes a pinch-off unit juxtaposed in physical contact against the cam for pressing the dispensing tube against the back plate when the cam rotates a predetermined distance, wherein the pinch-off unit includes a roller that presses the dispensing tube against the back plate to prevent the product from returning to the container until the press plate fully discharges the product through the open end of the dispensing tube. The press-plate is located between the pinch-off unit and the open end of the dispensing tube and presses the dispensing tube against the back plate progressively from the area closest to the pinch-off unit to the open end of the dispensing tube. The back plate is removably attached to the housing, the back plate may be replaced with another back plate to accommodate another dispensing tube having different dimensions than the dispensing tube. The back plate contains a gap for inserting one or more adjustment plates to change the flexibility of the back plate. The dispenser apparatus can include a check valve in another end of the dispensing tube furthest from the open end to prevent the product from returning to the container while the press plate fully discharges the product through the open end of the dispensing tube.

Another embodiment of the present invention relates to a dispensing method having the steps of. storing a product in a container; directing a flow of the product from the container through a dispensing tube to an open end thereof; rotating a cam using a motor; extending a press plate attached to the cam through a crank; pressing the dispensing tube against a back plate using the press plate when the cam rotates a predetermined distance; and discharging the product through the open end of the dispensing tube. The rotating step is triggered when a user places an object within a predetermined proximity to a sensing unit, wherein the rotating step is performed a predetermined number of times by pre-selecting a number of units of the product to be discharged when a user places an object within a predetermined proximity to the sensing unit. The discharging step includes discharging one unit of the product when the cam rotates one complete cycle. The storing step includes storing the product in one of a disposable container and a refillable container. The directing step includes directing the flow of the product from an exit port located on the container through the dispensing tube to the open end thereof, wherein the directing step includes removably attaching the dispensing tube to the exit port of the container. The method further involves permitting unidirectional dispensing of the product from the container using a check valve located in the open end of the dispensing tube. The rotating step includes rotating a rotatable output shaft of the motor with a gear mounted thereon that engages a final gear mounted on the cam through at least one gear. The method teaches pinching the dispensing tube against the back plate when the cam rotates a predetermined distance using a pinch-off unit juxtaposed in physical contact against the cam, wherein the pinching step includes pressing the dispensing tube against the back plate using a roller attached to the pinch-off unit to prevent the product from returning to the container until the press plate fully discharges the product through the open end of the dispensing tube. The pressing step includes pressing the dispensing tube against the back plate progressively from the area closest to the pinch-off unit to the open end of the dispensing tube such that the press-plate is located between the pinchoff unit and the open end of the dispensing tube. The method typically includes replacing the back plate with another back plate to accommodate another dispensing tube having different dimensions than the dispensing tube, and inserting one or more adjustment plates in a gap in the back plate contains to change the flexibility of the back plate. The method also involves preventing the product from returning to the container while the press plate fully discharges the product through the open end of the dispensing tube using a check valve in another end of the dispensing tube furthest from the open end.

DETAILED DESCRIPTION OF THE INVENTION

Figure 1:
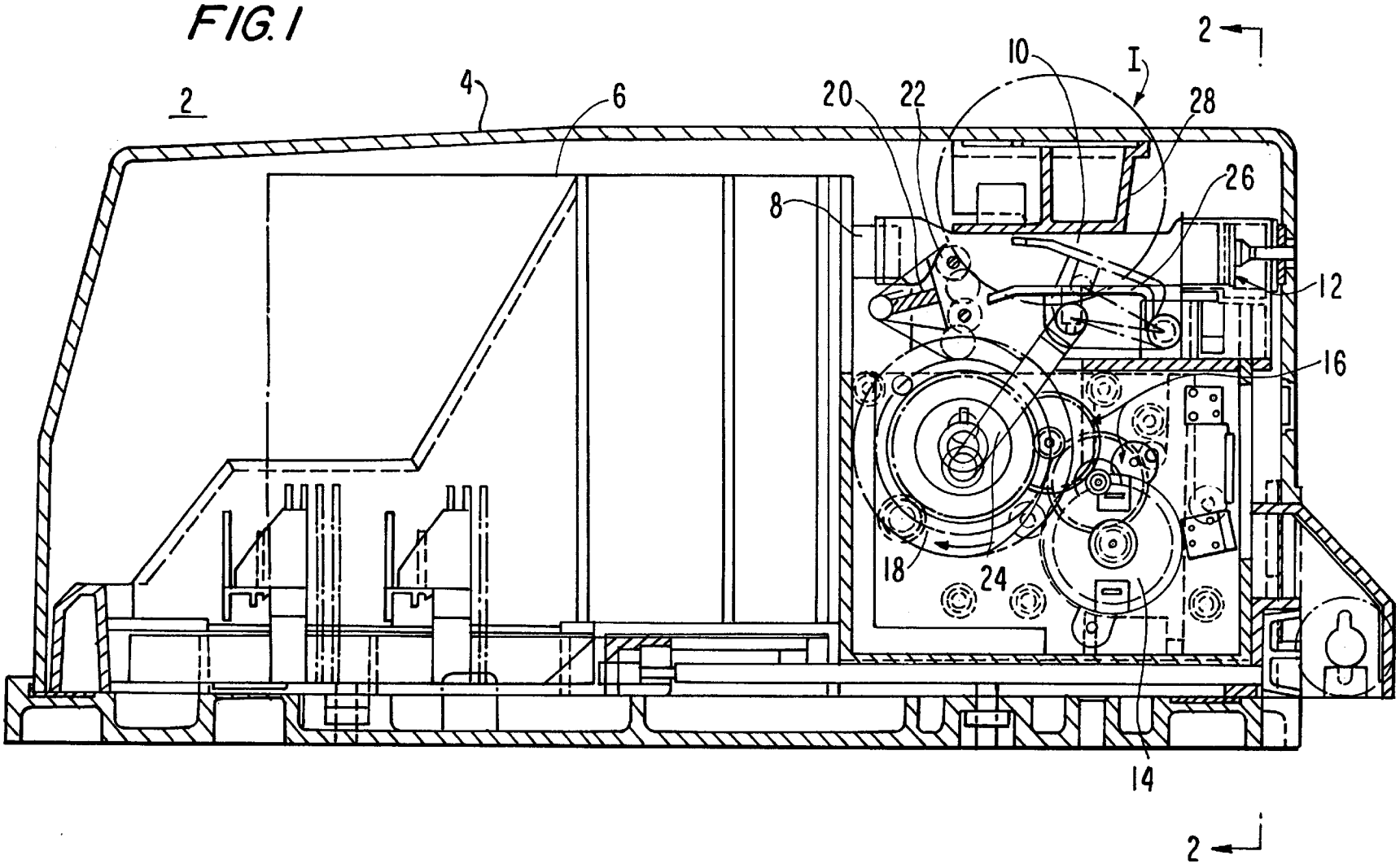
FIG. 1 shows a cutaway side view of a first embodiment of the dispenser apparatus according to the present invention.
Figure 2:
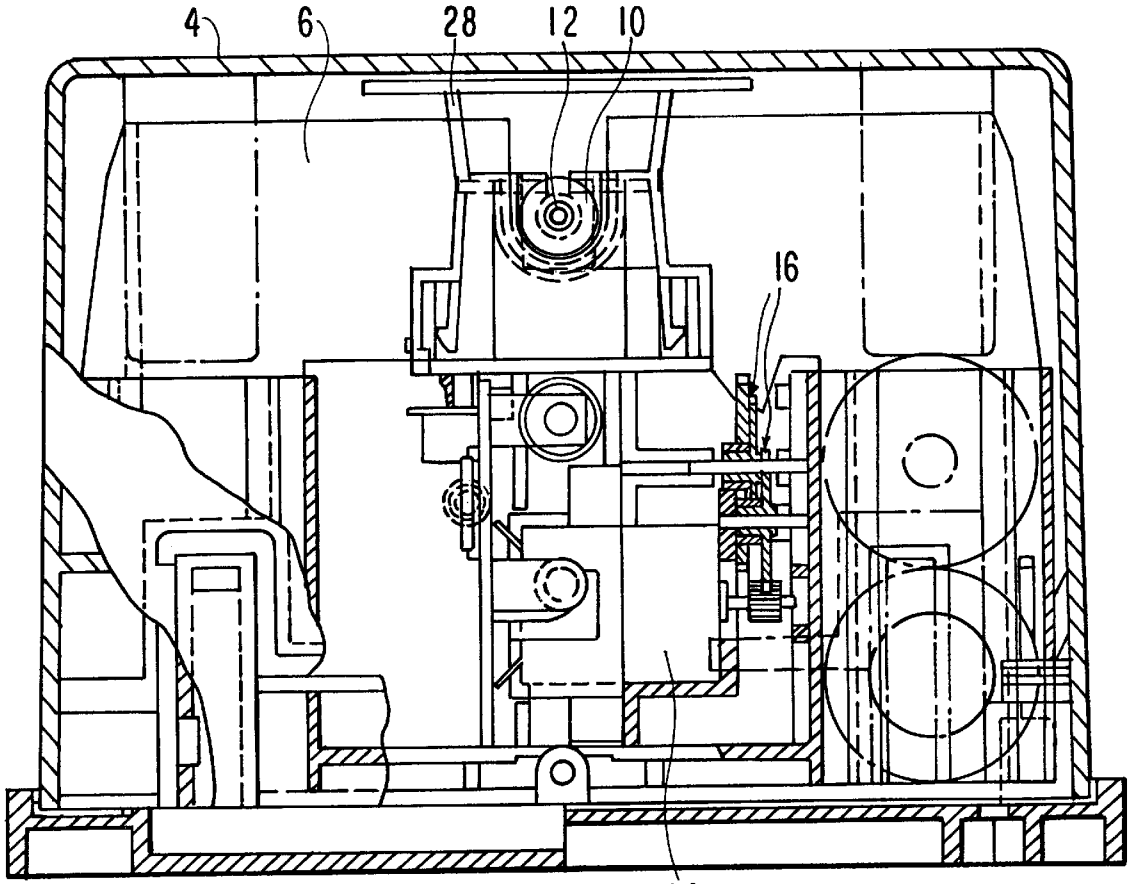
FIG. 2 shows a cutaway bottom view of a first embodiment of the dispenser apparatus according to the present invention.

A preferred embodiment of an automatic dispenser apparatus is shown in FIG. 1 and FIG. 2. The housing 4 encloses and supports the inner workings of the apparatus. It is usually composed of smooth hard plastic or a similar material that is easily cleaned to discourage contamination by bacteria, mold, mildew or the like. The housing 4 may be molded or formed into a variety of shapes and sizes as necessary to meet the requirements of the user. It is typically mounted on a wall with screws, double-sided tape, or other fasteners near a wash area or sink. A cover that opens is provided to facilitate replacement of product in a container 6, replacement of the container 6 as a whole unit, or removal/replacement of individual components as needed and described below. The cover may be entirely removable, or attached to the housing via a hinge, or the like.

The container 6 may be a disposable "bag-in-box" container, a refillable plastic container, or the like. A variety of products may be stored in the container 6, such as liquid soaps, lotions, or powder. The container 6 may be vacuum sealed, pressurized or gravity fed. The preferred embodiment utilizes a "bag-in-box" container because it provides a closed system vacuum that increases the efficiency of the dispenser 2 by virtually eliminating waste. The vacuum seal is also a cost-effective way to prevent contamination during shipping and handling. Refillable containers are necessarily open to be refilled from larger reservoirs containing product; both the containers and reservoirs are opened and re-opened numerous times, possibly allowing contaminants to enter each time. "Bag-in-box" containers also reduce waste by slowly collapsing and deforming into a small bag as they are used. This also eliminates the possibility of re-using the bag for some other purpose for which it was not designed.

An exit port 8 at the bottom of the container 6 from which the product is discharged mates with the top of a dispensing tube 10 that channels the product from the container 6 to a check valve 12. The dispensing tube 10 may screw onto, or simply fit snugly over, the exit port 8 in such a way so that the product from the container 6 will not leak out at the mating point when the dispensing tube 10 is squeezed. Various shapes and sizes may be used as necessary to accommodate various types of containers and adjust the amount of product that is dispensed. Alternatively, the tube may be an integral part of the container. The dispensing tube 10 is composed of rubber or other flexible material that can be repeatedly deformed by squeezing or pinching without losing its elasticity and breaking, thereby causing the product within to leak out. At its bottom end, furthest from the exit port 8, is a single check valve 12 that permits unidirectional dispensing of the product from the container 6, as described below.

A user triggers the dispenser 2 to dispense product by placing his hand, or some object, before a sensing unit (not shown). This sensing unit may use an infrared signal or any other type of wireless signal, so long as physical contact with the dispenser 2 is eliminated. A discharge cycle begins with the dispensing tube 10 in an uncompressed state filled with product from the container 6.

A motor 14 mounted in the housing 4 is activated by the dispenser circuitry (not shown) and drives a series of gears 16 that ultimately engage a cam 18. The motor 14 is a rotary motor with a rotatable output shaft with a gear mounted thereon. This gear drives the gears 16 that engage the cam 18 through a final gear that is attached to the cam 18 or is an integral part of the cam 18 itself. The gearing may be adjusted by selecting a combination of gear sizes and number of teeth to optimize power transfer from the motor 14 to the cam 18. This allows use of a relatively small motor 14 that conserves electrical power (battery power) while delivering enough torque to drive the cam 18 through a complete rotational cycle.

A pinch-off unit 20 in contact with the cam 18 is progressively extended as the cam 18 rotates. A roller 22 on the pinch-off unit 20 presses the dispensing tube 10 against a back plate 28 attached to a cover of the housing 4. As the cam 18 rotates, the dispensing tube 10 is fully closed off by the roller 22 on the pinch-off unit 20 to prevent any product from returning to the container 6. The area that is pinched-off is located close to the top of the dispensing tube 10 where it mates with the exit port 8. The roller 22 reduces the possibility of cutting into the dispensing tube 10, even after repeated discharge cycles.

A crank 24 is pivotally mounted on one end to the cam 18 close to the cam's center of rotation through a pin or other suitable means. As the cam 18 rotates further, the crank 24 extends towards the dispensing tube 10. A press plate 26 pivotally mounted on the distal end of the crank 24 compresses an area of the dispensing tube 10 from the pinch-off point to the check valve 12. The press plate 26 compresses the dispensing tube 10 against the back plate 28 progressively from top to bottom to reduce or eliminate waste of any product. The product is then ejected through the check valve 12 into the user's hand, typically a volume of 1 cc. per cycle. Up to this point of the discharge cycle, the cam 18 continues to keep the pinch-off unit 20 filly extended to prevent any product from returning to the container 6. The cam 18 continues to rotate and retracts the pinch-off unit 20, the crank 24, and the attached press plate 26 until all three items have returned to their original resting state at the end of the discharge cycle. As the dispensing tube 10 returns to its original uncompressed state, more product is drawn into the tube from the container 6. The number of discharge cycles for each time the sensing unit is triggered may be selected as required by specific applications, which number is typically one, three, or five cycles.

Alternatively, the functions of the crank 24 and the cam 18 may be reversed so that the crank 24 extends the pinch-off unit 20 to prevent any product from returning to the container 6 and the cam 18 extends the press plate 26 to compress the dispensing tube 10 to dispense the product.

The check valve 12 permits unidirectional discharge of the product when the dispensing tube 10 is compressed and prevents product from exiting when the dispensing tube 10 is in an uncompressed state. It also prevents product from re-entering the dispensing tube 10 once it has been discharged to reduce the chances of contamination. The check valve 12 may be an integral part of the dispensing tube 10 or may be a separate unit that mates with the bottom of the tube, like the exit port 8 of the container 6. This allows the manufacturer flexibility in choosing tubes and valves according to the customer's needs or specifications. It should be noted that while the check valve 12 is used in the preferred embodiment, other methods may be used. The open end of the dispensing tube 10 could be formed with slits that open when the product is forced through, or it could be a small opening like in an eyedropper that does not release product because of meniscus forces, or the like. These alternatives may be preferable in certain environments where contamination is not a major concern, or where cost savings are an issue.

In a second embodiment of the present invention, the dispenser 2 is equipped for operation with a dual check valve dispensing tube. Since the pinch-off unit 20 is designed for easy removal, it is eliminated and a second check valve is located where the exit port 8 mates with the dispensing tube 10. This check valve also permits unidirectional flow of product from the container 6 and prevents re-entry of product into the container 6 during a discharge cycle. The dispensing tube 10 is compressed only by the press plate 26 to discharge product from the container 6. In all other respects the operation is essentially the same as the first embodiment. While the additional cost of the second check valve may become significant in large volume applications, this embodiment necessarily uses less energy per discharge cycle. Therefore this embodiment may be preferred in cases where energy consumption is a primary concern, such as when using battery power. Power may also be provided by standard electrical outlets, solar power storage or the like.

Figure 3:
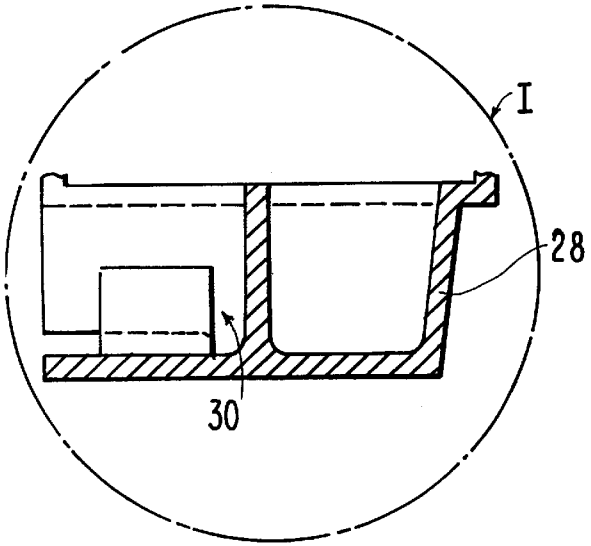
FIG. 3 shows a close-up cutaway view of the back plate according to the present invention.

It should be noted that the back plate 26 is removable to allow interchanging with other back plates to accommodate dispensing tubes with different dimensions, or for easy repair. The back plate 26 is also designed to be flexible enough to accommodate dispensing tube 10 dimension tolerances and to permit moderate over-travel of the pinch-off unit 20. The flexibility of the back plate 26 can be adjusted incrementally by inserting an adjustment plate 32 in a gap 30, as shown in FIG. 3. The adjustment plate 32 may completely fill the gap 30 and provide the least flexibility. The flexibility of the dispensing tube 10, the size of the dispensing tube 10 and the type of product to be dispensed are some of the factors that may influence how flexible the back plate 26 must be in order for the dispenser 2 to function correctly.

The above invention has been described with specific embodiments, but a person skilled in the art could introduce many variations on these embodiments without departing from the spirit of the disclosure or from the scope of the appended claims. The embodiments are presented for the purpose of illustration only and should not be read as limiting the invention or its application. Therefore, the claims should be interpreted commensurate with the spirit and scope of the invention.

We claim:

1. A dispenser apparatus comprising:

a housing;

a container inserted into said housing for storing a product;

a dispensing tube having an open end and being connected to said container to direct flow of the product from said container;

a back plate attached to said housing;

a motor mounted in said housing;

a cam rotatably driven by said motor;

a crank having a proximal end thereof mounted on said cam; and a press-plate connected to a distal end of said crank for pressing said dispensing tube against said back plate when said cam rotates a predetermined distance, thereby discharging the product through the open end of said dispensing tube.

2. The dispenser apparatus as set forth in claim 1, further comprising a sensing unit for triggering said motor to discharge a unit of the product when a user places an object within a predetermined proximity of said sensing unit.

3. The dispenser apparatus as set forth in claim 2, wherein said sensing unit triggers said motor so that a user-selectable number of units of the product are discharged when a user places an object within a predetermined proximity of said sensing unit.

4. The dispenser apparatus as set forth in claim 1, wherein one unit of the product is discharged when said cam rotates one complete cycle.

5. The dispenser apparatus as set forth in claim 1, wherein said container is one of a disposable container and a refillable container.

6. The dispenser apparatus as set forth in claim 1, further comprising an exit port located on said container from which the product is discharged.

7. The dispenser apparatus as set forth in claim 6, wherein said dispensing tube is removably attached to said exit port of said container.

8. The dispenser apparatus as set forth in claim 1, further comprising a check valve located in the open end of said dispensing tube, thereby providing unidirectional dispensing of the product from said container.

9. The dispenser apparatus as set forth in claim 1, wherein said motor has a rotatable output shaft with a drive gear mounted thereon that engages a final gear mounted on said cam through at least one intermediate gear.

10. The dispenser apparatus as set forth in claim 1, further comprising a pinch-off unit juxtaposed in physical contact against said cam for pressing said dispensing tube against said back plate when said cam rotates a predetermined amount.

11. The dispenser apparatus as set forth in claim 10, wherein said pinch-off unit includes a roller for pressing said dispensing tube against said back plate to prevent the product from returning to said container until said press plate filly discharges the product through the open end of said dispensing tube.

12. The dispenser apparatus as set forth in claim 1, wherein said press-plate is located between said pinch-off unit and the open end of said dispensing tube and presses said dispensing tube against said back plate progressively from a point closest to said pinch-off unit to the open end of said dispensing tube.

13. The dispenser apparatus as set forth in claim 1, wherein said back plate is removably attached to said housing.

14. The dispenser apparatus as set forth in claim 13, wherein said housing is formed so that said back plate is replaceable with a second back plate to accommodate a second dispensing tube having different dimensions than said dispensing tube.

15. The dispenser apparatus as set forth in claim 1, wherein said back plate contains a gap for inserting one or more adjustment plates to change a flexibility quality of said back plate.

16. The dispenser apparatus as set forth in claim 1, farther comprising a check valve in a second end of said dispensing tube furthest from the open end, to prevent the product from returning to said container while said press plate fully discharges the product through the open end of said dispensing tube.

17. A dispensing method comprising the steps of:

storing a product in a container;

directing a flow of the product from the container through a dispensing tube to an open end thereof;

rotating a cam using a motor;

extending a press plate attached to the cam through a crank;

pressing the dispensing tube against a back plate using the press plate when the cam rotates a predetermined amount; and discharging the product through the open end of the dispensing tube.

18. The dispensing method as set forth in claim 17, further comprising the step of triggering said rotating step when a user places an object within a predetermined proximity of a sensing unit.

19. The dispensing method as set forth in claim 18, further comprising the step of performing said rotating step a predetermined number of times by pre-selecting a number of units of the product to be discharged when a user places an object within a predetermined proximity to the sensing unit.

20. The dispensing method as set forth in claim 17, wherein said discharging step includes discharging one unit of the product when the cam rotates one complete cycle.

21. The dispensing method as set forth in claim 17, wherein said storing step includes storing the product in one of a disposable container and a refillable container.

22. The dispensing method as set forth in claim 17, wherein said directing step includes directing the flow of the product from an exit port located on the container through the dispensing tube to the open end thereof.

23. The dispensing method as set forth in claim 22, wherein said directing step includes removably attaching the dispensing tube to the exit port of the container.

24. The dispensing method as set forth in claim 17, further comprising the step of causing unidirectional flow of the product from the container using a check valve located in the open end of the dispensing tube.

25. The dispensing method as set forth in claim 17, wherein said rotating step includes rotating a rotatable output shaft of the motor with a drive gear mounted thereon that engages a final gear mounted on the cam through at least one intermediate gear.

26. The dispensing method as set forth in claim 17, further comprising the step of pinching the dispensing tube against the back plate when the cam rotates a predetermined distance using a pinch-off unit juxtaposed in physical contact against the cam.

27. The dispensing method as set forth in claim 26, wherein said pinching step includes pressing said dispensing tube against said back plate using a roller attached to the pinch-off unit to prevent the product from returning to said container until the press plate fully discharges the product through the open end of the dispensing tube.

28. The dispensing method as set forth in claim 17, wherein said pressing step includes pressing the dispensing tube against the back plate progressively from the area closest to the pinch-off unit to the open end of the dispensing tube such that the press-plate is located between the pinch-off unit and the open end of the dispensing tube.

29. The dispensing method as set forth in claim 17, further comprising the step of replacing the back plate with another back plate to accommodate another dispensing tube having different dimensions than the dispensing tube.

30. The dispensing method as set forth in claim 17, further comprising the step of inserting one or more adjustment plates in a gap in the back plate contains to change the flexibility of the back plate.

31. The dispensing method as set forth in claim 17, further comprising the step of preventing the product from returning to the container while the press plate fully discharges the product through the open end of the dispensing tube by using a check valve in another end of the dispensing tube furthest from the open end.

* * * * *